United States Patent [19]

Smith

[11] 4,307,926

[45] Dec. 29, 1981

[54] TRIAXIAL CONNECTOR ASSEMBLY

[75] Inventor: Donald L. Smith, Middletown, Pa.

[73] Assignee: AMP Inc., Harrisburg, Pa.

[21] Appl. No.: 110,421

[22] Filed: Jan. 7, 1980

Related U.S. Application Data

[63] Continuation of Ser. No. 31,899, Apr. 20, 1979, abandoned.

[51] Int. Cl.[3] ..... H01R 17/08

[52] U.S. Cl. ..... 339/177 R

[58] Field of Search ..... 339/177 R, 177 E, 182 R, 339/182 RS, 183; 174/75 C, 89

[56] References Cited

U.S. PATENT DOCUMENTS

| | | | |
|---|---|---|---|
| 2,480,963 | 9/1949 | Quinn | 339/182 R |
| 2,862,993 | 12/1958 | Schmidt | 174/75 |
| 3,141,924 | 7/1964 | Forney, Jr. | 339/128 |
| 3,144,292 | 8/1964 | Forney, Jr. | 339/128 |
| 3,154,360 | 10/1964 | Plishner | 339/183 |
| 3,244,796 | 4/1966 | Stark et al. | 174/77 |
| 3,253,250 | 5/1966 | Harrison et al. | 339/177 R |
| 3,281,756 | 10/1966 | O'Keefe et al. | 339/89 |
| 3,383,457 | 5/1968 | Schumacher et al. | 174/68.5 |
| 3,471,825 | 10/1969 | Huber | 339/61 |
| 3,551,882 | 12/1970 | O'Keefe | 339/177 |
| 3,598,895 | 8/1971 | Garland | 339/177 R |
| 3,670,293 | 6/1972 | Garver | 339/177 |
| 3,694,793 | 9/1972 | Concelman | 339/177 R |
| 3,701,086 | 10/1972 | Somerset | 339/177 R |
| 3,982,060 | 9/1976 | Avery et al. | 339/177 R |

FOREIGN PATENT DOCUMENTS

| | | | |
|---|---|---|---|
| 594294 | 1/1978 | Sweden | 339/182 R |

*Primary Examiner*—Neil Abrams

*Attorney, Agent, or Firm*—Gerald K. Kita

[57] ABSTRACT

An electrical connector assembly is disclosed for terminating a triaxial or twin axial cable of the type having two center conductors which are dressed for termination to extend forward respective distances free from a dielectric casing, conductive shield, and outer sheath therearound. The assembly includes a center contact, an inner bored body, an inner ferrule, an outer bored body, and an outer ferrule. The center contact is affixed to the end of a forwardmost extending one of the two center conductors and is thereafter inserted into the inner body having preinserted dielectric means for insulating the center contact. The inner ferrule is radially crimped upon a rearward portion of the inner body having a forward uninsulated end of the second cable center conductor position thereagainst. Subsequently, the inner body is inserted into the outer body having preinserted dielectric means for insulating the inner body having a rearward sleeve portion interposed between forward ends of the cable shield and dielectric casing. The outer ferrule is thereafter radially crimped upon the forward end of the cable shield to fixedly common the shield to the outer body sleeve positioned therebeneath.

12 Claims, 8 Drawing Figures

Fig. 7
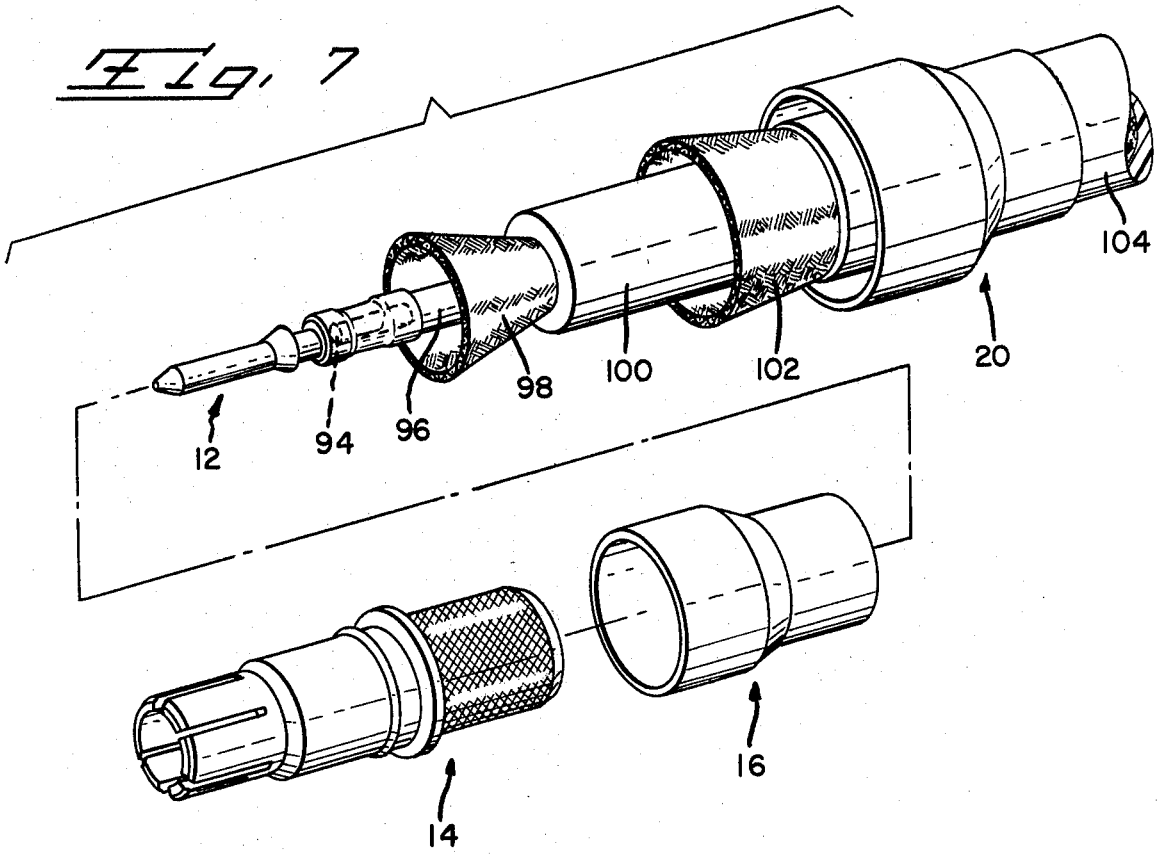
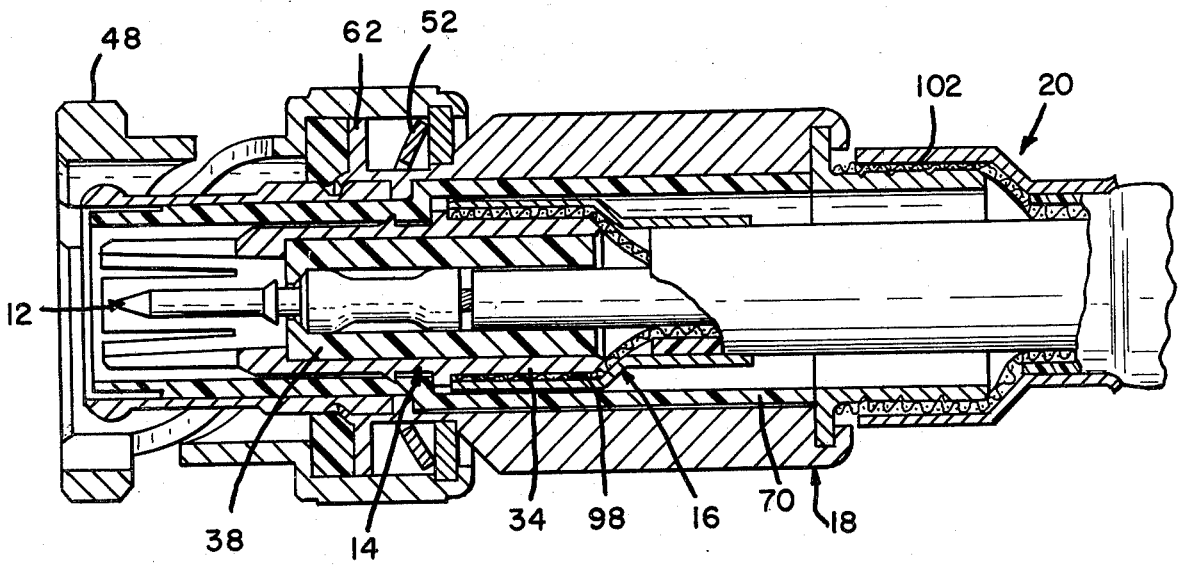
Fig. 8

TRIAXIAL CONNECTOR ASSEMBLY

This is a continuation of application Ser. No. 31,899, filed Apr. 20, 1979, now abandoned.

BACKGROUND OF THE INVENTION

1. Field of the Invention

This invention relates to coaxial connector assemblies in general, and in particular to connector assemblies for terminating an electrical triaxial or twin axial cable of the type having two center connectors encased by dielectric means, a conductive shield, and an outer insulative sheath.

2. Description of the Prior Art

In many electrical interconnection applications multiple transmission paths between electrical instruments is required. For such applications, electrical cables have been developed providing multiple conducting paths and, moreover, providing shielding means for shielding these multiple paths from the influence of electromagnetic interference. One type of cable, known within the industry as a triaxial cable, comprises a center wire conductor surrounded by first dielectric and braided shield layers, which are in turn surrounded by second dielectric and braided shield layers. A second type of cable, known as a twin axial cable, includes two center wire conductors, a spacing dielectric layer therearound, and an outer shield around the dielectric layer. Use of these cables, however, has been retarded by the industry's failure to develop electrical connectors for inexpensively, yet effectively and easily achieving cable end termination. Consequently, the industry is in need of an electrical connector which is inexpensive to produce, readily assembled, and which can positively terminate a triaxial or twin axial cable. Ideally, one connector should be capable of terminating either a twin axial or triaxial cable at the option of the user, for this capability would greatly recommend standardization of connector parts and thereby reduce the overall cost of the resulting assembly.

The industry's efforts in developing such a connector have been unsuccessful. Many relatively complicated connectors have been proposed for terminating a twin axial or triaxial cable, but no one connector has been achieved which can easily and effectively terminate either, in a given cable size, at the option of the user. A further problem has been that heretofore proposed connector assemblies comprised numerous loose-piece parts intended for assembly by the user using either a soldering or crimping technique, in a time consuming and therefore expensive procedure. One connector, disclosed in U.S. Pat. No. 3,701,086, is representative of the prior art and comprises a plurality of components assembled by a relatively complicated procedure. While this connector has been well received by the industry, certain shortcomings prevent the connector from representing an ideal solution to the industry's needs. The connector assembly comprises a relatively large number of assembly components which, because of structural limitations and the method of assembly, do not lend themselves to cost-saving preassembly. Further, effective contact preservation between components of this connector assembly is not automatically assured, but rather depends on preservation of proper tension between assembled components by a threaded housing-/coupling nut arrangement.

SUMMARY OF THE INVENTION

The present connector assembly comprises five major components, namely: an inner bored body member having a preinserted dielectric bushing therein, an inner crimped ferrule, a center contact, an outer bored body member having a preinserted dielectric bushing therein, and an outer crimped ferrule. The center contact is affixed to the end of a forwardmost extending cable conductor and is thereafter inserted into the inner body. A forward end of a second center conductor, which likewise is prepared to extend forward free of the dielectric casing and shield therearound, is positioned against a rearward exterior surface of the inner body and crimped thereto by the inner ferrule. Subsequently, the inner body is inserted into the outer body as a rearward sleeve of the outer body is interposed between forward ends of the cable shield and the dielectric casing. The outer ferrule is thereafter radially crimped upon the forward end of the cable shield to complete the assembly procedure. The center contact, inner body, and outer body each present forward mating ends at the front end of the connector unit, and they primarily contact the first cable center conductor, second cable center conductor and outer shield, respectively, through positive crimping engagement to thereby insure the integrity of the resulting connection.

Accordingly, it is an object of the present invention to provide an electrical connector assembly for positively terminating a triaxial or shielded twin axial electrical cable.

It is a further object of the present invention to provide an electrical connector assembly for terminating a triaxial or shielded twin axial cable having a minimal number of components.

A further object of the present invention is to provide an electrical connector assembly which can be assembled by the user.

A still further object of the present invention is to provide an electrical connector assembly which is self-polarizing.

A still further object of the present invention is to provide an electrical connector assembly for terminating either a triaxial or shielded twin axial cable at the option of the user.

A further object of the present invention is to provide an electrical connector assembly which is economically and readily produced, and readily assembled.

These and other objects, which will be apparent to one skilled in the art, are achieved by a preferred embodiment of the present invention which is described in detail below, and illustrated in the accompanying drawings.

BRIEF DESCRIPTION OF THE ACCOMPANYING DRAWINGS

FIG. 7 is an exploded perspective view of a triaxial cable having the center contact and subject outer ferrule affixed thereto, and having the subject inner body and inner ferrule exploded therefrom.

FIG. 8 is a side elevation view partially in section of the subject assembled connector assembly terminating the triaxial cable illustrated in FIG. 7.

DETAILED DESCRIPTION OF THE PREFERRED EMBODIMENT

Figure 2:
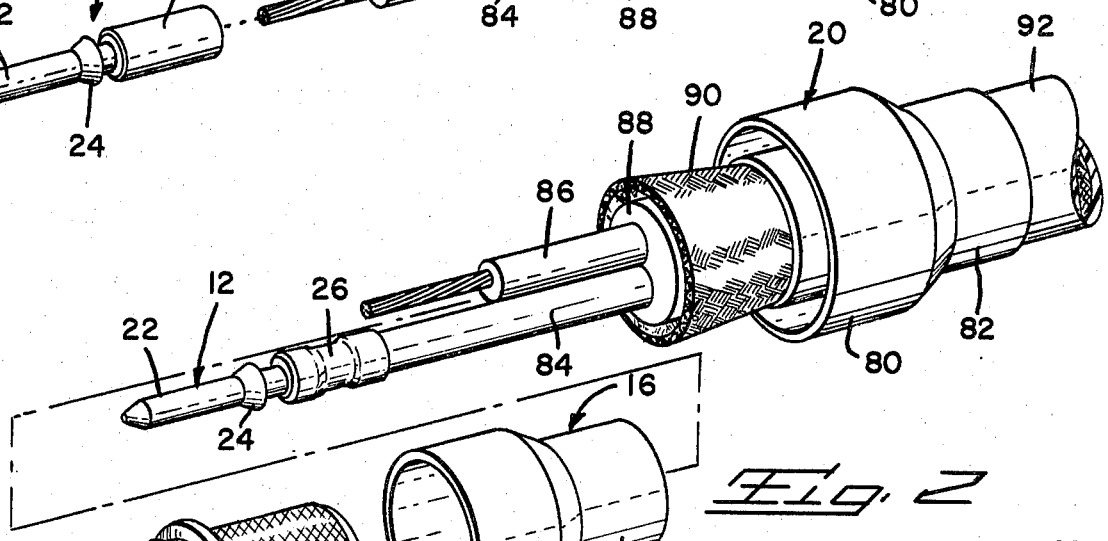
FIG. 2 is an exploded perspective view of the cable illustrated in FIG. 1 having the subject center contact affixed thereto, and having the subject inner body and inner ferrule exploded therefrom.
Figure 4:
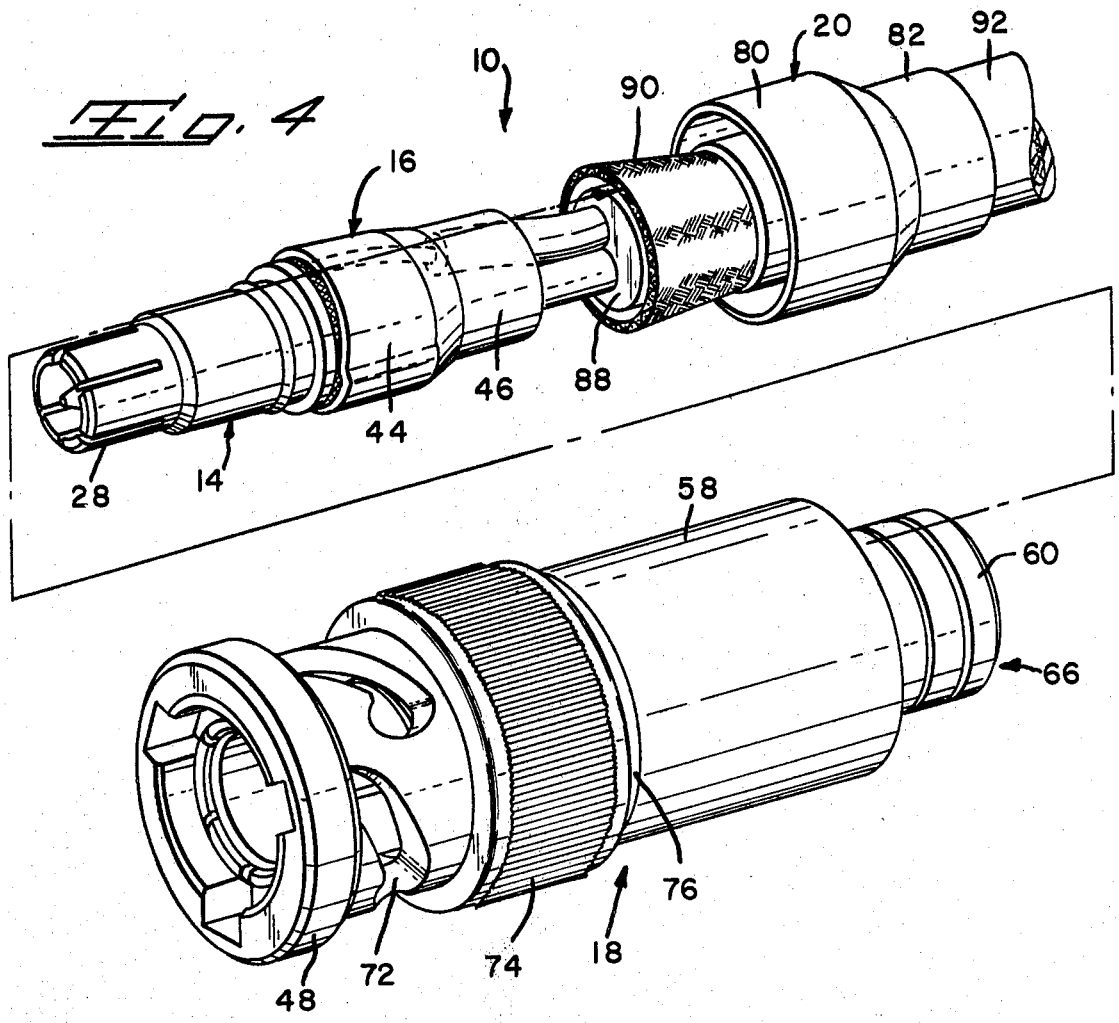
FIG. 4 is an exploded perspective view of the twin axial cable illustrated in FIGS. 1, 2 and 3, and the subject outer connector body.
Figure 5:
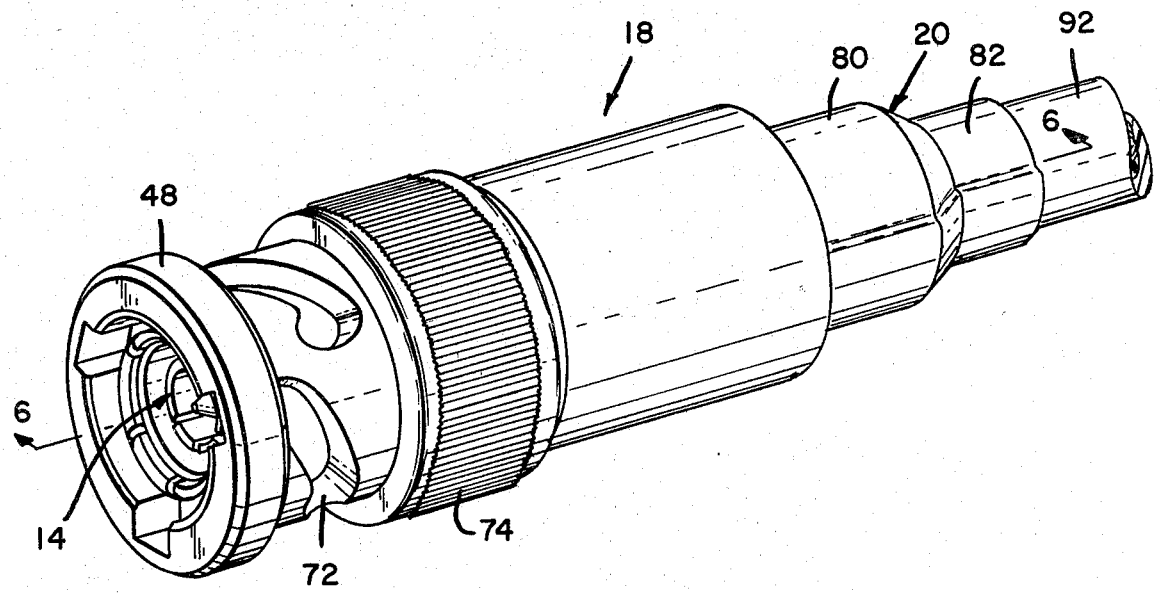
FIG. 5 is a perspective view of the assembled subject connector assembly.
Figure 6:
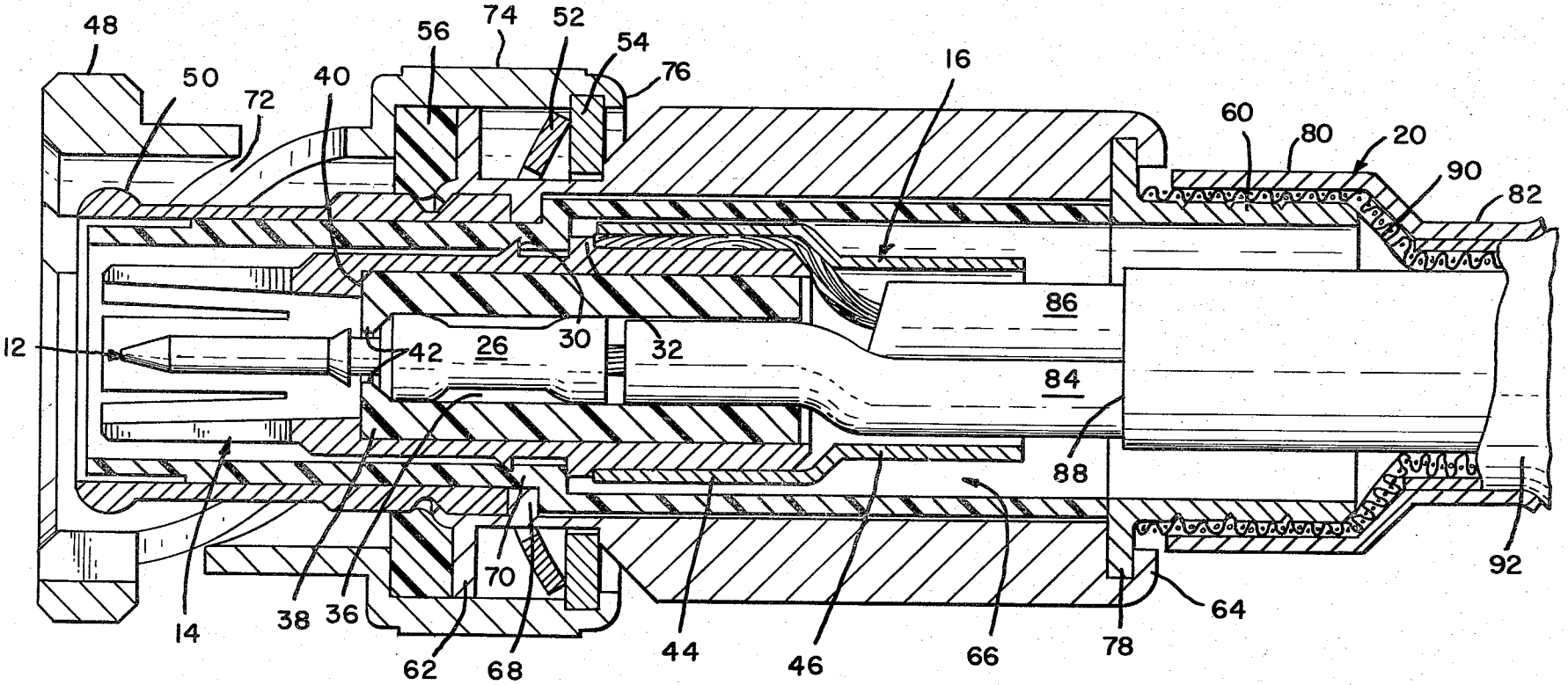
FIG. 6 is a side elevation view partially in section taken through the line 6—6 of FIG. 5.

Referring first to FIGS. 2, 4 and 6, the subject connector assembly 10 is shown to comprise a center contact 12, an inner body 14, an inner ferrule 16, an outer body assembly 18, and an outer ferrule 20. The center contact 12 includes a forward pin portion 22, an annular flange 24, and a rearward crimpable barrel portion 26. The inner body 14 comprises a generally forward hood portion 28, an annular latching ridge 30, and annular retention flange 32, and a knurled rearward portion 34. As shown best by FIG. 6, the inner body 14 further is provided with a profiled bore 36 therethrough receiving a dielectric bushing member 38 preinserted therein against an internal shoulder 40. The dielectric bushing member 38 is provided with an inwardly directed annular locking lip 42 at the forward end for a reason explained below.

The inner ferrule 16 comprises a forward crimpable portion 44 of larger diameter, and a rearward portion 46 of smaller diameter. Continuing, as shown in FIGS. 4 and 6, the outer body assembly includes a collar member 48, a plug insert member 50, a spring washer 52, a lock washer 54, a gasket ring 56, a tubular shell body 58, and a rearward sleeve portion 60. The shell body 58 has an external forward annular flange 62, an inwardly directed annular lip 64, a profiled bore 66 therethrough, and an interior shoulder 68 projecting into the bore 66. Further comprising the shell body 68 is a profiled dielectric bushing member 70 which is preinserted within the bore 66 against the interior shoulder 68. The collar member 48 includes camming slots 72, an annular groove collar portion 74, and a rearward locking lip 76. As shown best by FIG. 6, the plug member insert 50 is inserted into a forward end of the shell body 58 and is subsequently affixed thereto by rolling over the forward end of the shell body as indicated. As illustrated, the spring washer 52 and locking washer 54 are mounted over a forward end of the shell body 58 rearward of the flange 62; the gasket 56 is mounted forward of the flange 62; and the collar locking lip 76 engages the washer 54 to hold the collar 48 to the assembly. Also, the rearward sleeve 60 provides a forward external annular flange 78 and is engageably secured to the shell body 58 by the shell flange 64 abutting against the flange 78. Lastly, as shown in FIG. 2, the outer ferrule 20 comprises a forward enlarged crimpable portion 80, and a rearward crimpable body portion 82 having a bore therethrough dimensioned as indicated below.

Figure 1:
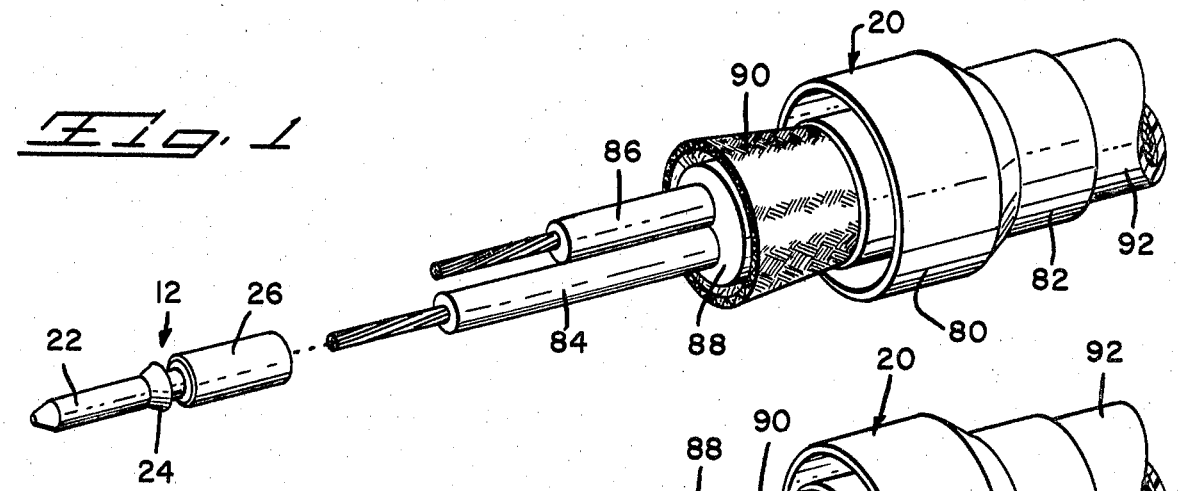
FIG. 1 is an exploded perspective view of a prepared twin axial shielded cable, having the subject outer ferrule mounted therearound.

Referring to FIG. 1, one type of cable which the subject connector assembly is intended to terminate comprises first and second insulated center conductors 84, 86, which are encased by a dielectric spacing layer 88 having a conductive shield 90 and an outer sheath 92 therearound. The center conductors 84, 86 are adaptably prepared to extend forward respective distances free of the forward ends of the dielectric layer 88 and the shield 90, with forward ends of the center conductors having the insulation therearound removed as indicated. Also, it should be noted that the outer sheath 92 is removed from an exposed forward length of the shield 90, and that the forward exposed length of the shield 90 has been flared by suitable means common within the industry.

Figure 3:
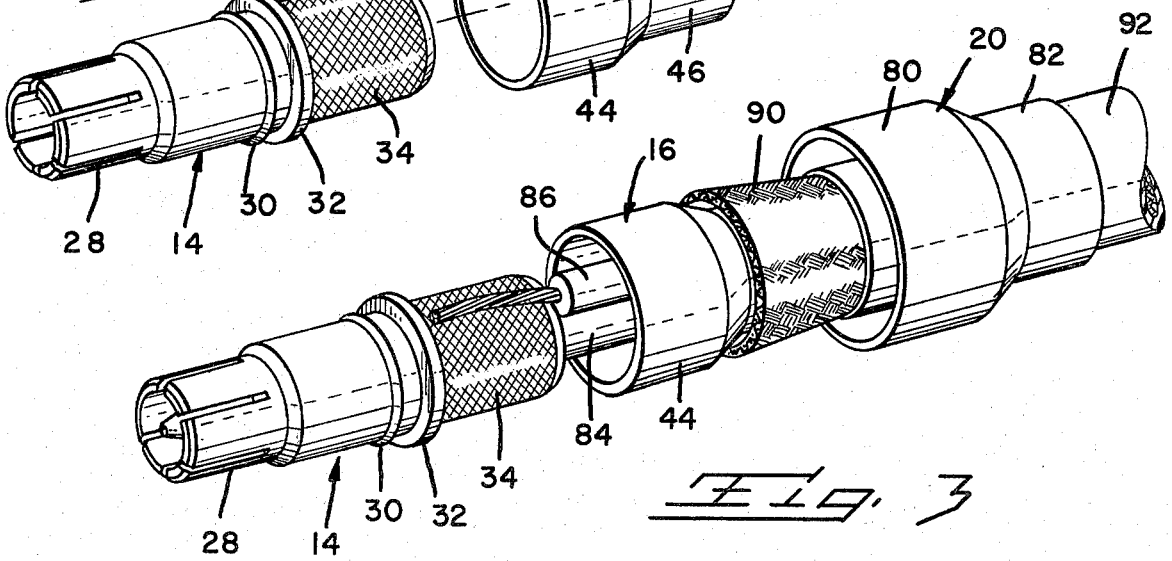
FIG. 3 is an exploded perspective view of the twin axial cable illustrated in FIGS. 1 and 2, having the subject center contact inserted within the inner body in accordance with the principles of the subject invention.

With continuing reference to FIGS. 1, 2 and 3, assembly of the instant connector assembly is initiated by drawing the subject cable through the outer ferrule 20. The center contact barrel receives the uninsulated forward end of the first forwardmost extending conductor 84 therein, and is subsequently crimped thereto by the user with appropriate tooling common to the industry. The free ends of the conductors 84, 86 are next drawn through the inner ferrule 16 which is temporarily positioned rearwardly as indicated by FIG. 3, with the rearward ferrule portion 46 interposed between the shield 90 and the cable dielectric layer 88. The center contact 12 and the forward end of the first conductor 84 crimped thereto are then inserted into the inner body dielectric bushing 38 as illustrated by FIGS. 3 and 6, with the forward end of the crimped barrel portion 26 abutting the locking lip 42 of the insert bushing 38. As illustrated, the forward uninsulated end of the conductor 86 is next axially positioned against the rearward knurled surface portion 34 at this stage in the procedure.

Assembly continues as, referring to FIGS. 4 and 6, the inner ferrule portion 44 is moved forwardly to encapsulate the knurled inner body portion 34 and the conductor positioned thereagainst. The ferrule portion 34 is then crimped in a manner common to the art to thereby effectuate secure electrical contacting engagement between the inner body 14 and the conductor 86. Subsequently, the inner body 14 and the inner ferrule 16 are inserted into the outer body bore 66 within the dielectric insert 70. The inner body annular flange 32 abuts an internal shoulder to preclude forward removal from the bore, and the annular ridge 30 bites into the dielectric insert 70 to prevent rearward removal of the inner body 24 from the bore 66. Upon insertion of the inner body 14 into the outer body 18, the outer body rearward sleeve 60 slides between the forward ends of the shield 90 and the dielectric layer 88. The forward enlarged portion 80 of the outer ferrule 20 is thereafter moved forward to encapsulate the forward ends of the shield, dielectric layer, and the outer body sleeve 60 as shown in FIG. 6. Subsequent crimping of the forward portion of the outer ferrule 20, by commonly available crimping tooling, establishes secure electrical contacting engagement between the shield 90 and the outer body 18, and completes the assembly of the subject connector unit. The resulting BNC-style connector plug assembly can be mated to a like BNC-style receptacle unit (not shown) without danger of cross-connecting the center conductor paths, since the forwardmost extending conductor of the terminated cable is always central of the connector plug assembly. That is, there is no possibility of crossing the paths of two cable conductors through mis-mating of connector halves since the orientation of the two conductors within the connector assembly is fixedly pre-established. The connector plug is, therefore, self-orienting. Also, it should be noted that the mating interface to the assembled connector comprises forward ends of the outer body 18, the inner body 14, and the center contact 12, which bodies being securely electrically connected to the shield 90 and conductors 86, 84 respectively, by crimping means. Thus, positive electrical paths are established and securely preserved between the connector assembly interface and the cable conductors by direct crimping to thereby insure the electrical integrity of the cable termination.

Referring now to FIG. 7, the subject connector assembly is further intended to terminate a second type of cable comprising an inner wire conductor 94 having an insulative covering 96 therearound, a first braided shield conductor 98, a dielectric casing 100, a second braided shield 102, and an outer sheath 104. In the manner described above, the cable is dressed such that the center conductor 94 and the first braided shield conductor 98 extend forward respective distances free of the forward ends of the dielectric casing 100 and the shield 102. FIG. 7 illustrates the center contact 12 in crimped electrical engagement with the center conductor 94, and the outer ferrule 20 receiving the triaxial-type cable therethrough. It will be appreciated that the same contact 12, outer ferrule 20, inner body 14, inner ferrule 16, and outer body (not shown) are used in terminating the triaxial cable illustrated in FIG. 7 as used in terminating the twin axial cable shown in FIG. 1. It further will be appreciated from FIG. 8, that the assembly procedure is likewise identical to the termination procedure recited above for the twin axial cable. The triaxial first conductive shield 98 is positioned over a rearward end of the inner body 14 against the outer knurled surface 34 thereof. The inner ferrule 16 is then moved forwardly and crimped over the shield 98 to effectuate secure contacting engagement between the shield 98 and the inner body 14. The outer body 18 then receives the inner body 14 therein, and the outer ferrule 20 is crimped over the outer braided shield 102 having the outer body sleeve portion 60 positioned therebeneath. It is within the contemplation of the present invention that the user of the subject connector assembly would, having received the above-described five components of the assembly as a kit or the like, assemble the connector to terminate either a triaxial or twin axial cable, depending on his needs. The dielectric bushings 38, 70 within the inner and outer bodies 14, 18, respectively, can be preinserted at the site of manufacture, thereby obviating additional steps of assembly and reducing the time required of the user in assembling the subject invention.

While the above description of the preferred embodiment exemplifies the principles of the subject invention, other embodiments which would be apparent to one skilled in the art and which utilize the teachings herein set forth are intended to be within the scope and spirit of the subject invention.

What is claimed is:

1. An electrical connector assembly for terminating an electrical cable of the type having first and second center conducting means encased by dielectric spacing means, a conductive shield encasing the dielectric spacing means, and an insulative sheath encasing the conductive shield, the connector assembly comprising:

center contact means securely affixed to the forward end of the forwardmost extending first cable center conducting means, said first and second cable conducting means being adapted to extend forward respective distances free of the forward ends of the dielectric spacing means and the shield;

a conductive inner body of unitary construction;

internal dielectric means having a profiled bore for receiving said center contact means therein;

said center contact means being exteriorly profiled for insertion into said bore of said internal dielectric means from a rearward direction;

said internal dielectric means being positioned within said inner body bore for electrically insulating said center contact means from said inner body;

a forward length of said second center conducting means being positioned in electrically contacting engagement with a rearward portion of said inner body;

said inner body having an integral forward connecting end adapted to engage mateably another connector assembly;

means for retaining said forward length of said second center conducting means in said engagement with said inner body;

a conductive outer body;

outer dielectric means defining a profiled bore for receiving said inner body therein;

said inner body being externally profiled for insertion into said bore of said outer dielectric means from a rearward direction;

said outer dielectric means being positioned within said bore for electrically insulating said inner body from said outer body;

said outer body having a rearward sleeve portion interposed between forward lengths of the conductive shield and dielectric spacing means and being in electrical contact with the conductive shield;

said inner body being insertable through said rearward sleeve portion and into said bore of said outer dielectric means; and means for retaining said sleeve portion between said forward lengths of said dielectric spacing means and the conductive shield.

2. The electrical connector assembly as recited in claim 1, wherein said forward length of said second conducting means being located against an external surface of said rearward portion of said inner body, and said means for retaining said forward length comprising inner crimped ferrule means.

3. An electrical connector assembly of the type having a forward mating end for engaging mateably with further connector assembly means and being intended for terminating an electrical cable of the type having first and second center conducting means encased by dielectric spacing means, a conductive shield encasing the dielectric spacing means, and an insulative sheath encasing the conductive shield, the connector assembly comprising:

center contact means securely affixed to the forward end of the forwardmost extending first center conducting means, said first and second center conducting means being adapted to extend forward respective distances free of the forward ends of the dielectric spacing means and the shield;

a unitary conductive inner body;

an internal dielectric means having a bore profiled for receiving said center contact means therein;

said center contact means being exteriorly profiled for insertion into said bore of said internal dielectric means from a rearward direction;

said internal dielectric means being positioned within said inner body bore for electrically insulating said center contact means from said inner body;

a forward length of said second center conducting means being positioned in electrically contacting engagement with a rearward portion of said inner body;

said inner body continuously extending forward to a forward mating end of said connector assembly, and having an integral forward end adapted for engaging mateably with further connector assembly means;

means for retaining said forward length of said second center conducting means in said engagement with said inner body;

a conductive outer body;

outer dielectric means having a bore profiled for receiving said inner body therein;

said inner body being exteriorly profiled for insertion into said bore of said outer dielectric means from a rearward direction;

said internal dielectric means being adapted for positionment within said bore for electrically insulating said inner conductive body from said outer conductive body;

said outer body having a rearward sleeve portion interposed between forward lengths of the shield and dielectric spacing means and being in electrical contact with the shield;

said inner body being insertable through said rearward sleeve portion of said inner body and into said outer dielectric means; and means for retaining said sleeve portion between said forward ends of the shield and dielectric spacing means and in said electrical contact with the shield.

4. The electrical connector assembly as recited in claim 3, wherein the forward length of said second conducting means being located against an external surface of said rearward portion of said inner body, and said means for retaining said forward length comprising inner crimped ferrule means.

5. The electrical connector assembly as recited in claim 3, wherein the forward length of the cable shield having a forward length of the insulative sheath removed from therearound, and said means for retaining said sleeve portion of said outer body between the forward lengths of the shield and dielectric spacing means comprising outer crimped ferrule means.

6. The electrical connector assembly as recited in claim 3, wherein said center contact means comprising a terminal member having a forward pin portion and a rearward receptacle portion crimped to said forward end of said one conductor.

7. The electrical connector assembly as recited in claim 3, wherein forward ends of said center contact means and said inner conductive body being profiled for mating engagement with said further connector contact means, and being located at said forward mating end of said connector assembly.

8. The electrical connector assembly as recited in claim 3, wherein said center contact means comprising an elongate terminal member, and said inner conductive body substantially receiving the axial length of said elongate terminal member therein.

9. An electrical connector assembly kit for an electrical connector of the type having a forward mating end for engaging a further connector assembly, and intended for terminating an electrical cable of the type having first and second center conducting means adapted to extend forward respective distances free of forward ends of dielectric spacing means encasing the center conducting means and a conductive shield encasing the dielectric spacing means and an insulative sheath encasing the shield, the kit comprising;

center contact means engageable with the forward end of the forwardmost extending first center conducting means;

a conductive inner body;

internal dielectric means having a profiled bore adapted to receive said center means therein;

said center contact means being exteriorly profiled for insertion into said bore of said internal dielectric means from a rearward direction;

said center contact means having forward ends profiled to engage matingly said further connector assembly;

said internal dielectric means adapted for being positioned within said bore for insulating said center contact means from said inner body;

a rearward portion of said inner body being adapted for engageably contacting a forward length of said second center conducting means;

means for retaining said forward length of said second conducting means in contacting engagement with said inner conductive body rearward portion;

a conductive outer body;

outer dielectric means having a profiled bore adapted to receive said inner body therein;

said inner body being exteriorly profiled for insertion into said bore of said outer dielectric means from a rearward direction;

said internal dielectric means adapted for positionment on said outer body for insulating said inner body from said outer body;

said outer body having a rearward sleeve portion dimensioned for positionment between forward lengths of the shield and dielectric spacing means and in electrical contact with the shield;

said inner body being adapted for insertion through said rearward sleeve portion and into said profiled bore of said outer dielectric means; and means for retaining said outer sleeve portion between the shield and dielectric spacing means and in electrical contact with the shield.

10. An electrical connector kit as recited in claim 9, wherein said inner conductive body comprising a unitary elongate cylindrical member.

11. An electrical connector kit as recited in claim 10, wherein said center contact means comprising an elongate terminal member, and said unitary cylindrical member being adapted to receive substantially the entire axial length of said elongate terminal member therein.

12. An electrical connector assembly for terminating an electrical cable of the type having first and second center conducting means encased by dielectric spacing means, a conductive shield, and an insulative sheath encasing the conductive shield, the connector assembly comprising:

a center contact securely affixed to the forward end of the forwardmost extending first center conducting means, said first and second center conducting means being adapted to extend forward respective distances free of the forward ends of the dielectric spacing means and the shield;

a conductive inner body of unitary construction;

internal dielectric means having a profile bore for receiving said center contact therein;

said internal dielectric means being positioned within said inner body bore for electrically insulating said center contact from said inner body;

said center contact being exteriorly profiled for insertion into said inner body bore from a rearward direction;

said inner body having a rearward portion for engagement against a forward length of said second center conducting means;

ferrule means for retaining in said engagement said inner body rearward portion, said forward length of said second center conducting means and said inner body;

a conductive outer body having internally thereof an outer dielectric means defining a profiled bore for receiving said inner body therein;

said outer dielectric means being positioned within said bore for electrically insulating said inner body from said outer body said inner body being exteriorly profiled for insertion into said bore of said outer dielectric means from a rearward direction;

said inner body having annular means for engaging said outer dielectric means to prevent withdrawal of said inner body;

said outer body having a rearward sleeve portion adapted for positioning between forward lengths of the dielectric spacing means and the shield and in electrical contact with the shield;

said inner body being insertable through said rearward sleeve portion and into said bore of said outer dielectric means; and ferrule means for retaining said rearward sleeve portion between said forward ends of said shield and dielectric spacing means and in electrical contact with said shield.

* * * * *